US005694839A

United States Patent [19]

Wohl et al.

[11] Patent Number: 5,694,839

[45] Date of Patent: Dec. 9, 1997

[54] METHOD AND APPARATUS FOR PAD PRINTING CYLINDRICAL ITEMS

[75] Inventors: Terrence Wohl, Bartlett; Peter Atkinson, Streamwood; Danny R. Hessert, Carol Stream, all of Ill.

[73] Assignee: Trans Tech America, Inc., Carol Stream, Ill.

[21] Appl. No.: 715,647

[22] Filed: Sep. 18, 1996

[51] Int. Cl.[6] ..... B41F 17/08

[52] U.S. Cl. ..... 101/39

[58] Field of Search ..... 101/39, 40

[56] References Cited

U.S. PATENT DOCUMENTS

| | | | |
|---|---|---|---|
| 2,972,295 | 2/1961 | Tiritilli | 101/40 |
| 4,060,031 | 11/1977 | Philipp | 101/163 |
| 4,508,032 | 4/1985 | Philipp | 101/163 |
| 4,557,195 | 12/1985 | Phillipp | 101/163 |
| 4,905,594 | 3/1990 | Phillipp et al. | 101/163 |
| 5,222,433 | 6/1993 | Philipp | 101/163 |
| 5,426,557 | 6/1995 | Blitshteyn et al. | 361/225 |
| 5,476,040 | 12/1995 | Kleist | 101/163 |
| 5,537,921 | 7/1996 | Adner et al. | 101/35 |

FOREIGN PATENT DOCUMENTS

| | | | |
|---|---|---|---|
| 483973 | 8/1917 | France | 101/39 |

*Primary Examiner*—Edgar S. Burr
*Assistant Examiner*—Amanda B. Sandusky
*Attorney, Agent, or Firm*—Leydig, Voit & Mayer,Ltd.

[57] ABSTRACT

A method and apparatus for pad printing images around cylindrical items. The apparatus includes a gravure plate, image, a flexible ink transfer pad for receiving an ink image from the gravure plate and transferring the image onto a flat silicon ink transfer plate, and a flat silicon pressure plate for engaging a cylindrical item positioned on the ink transfer plate and rolling the cylindrical item across the ink transfer plate for applying the image about the outer periphery of the cylindrical item in a continuous one step operation.

35 Claims, 3 Drawing Sheets

METHOD AND APPARATUS FOR PAD PRINTING CYLINDRICAL ITEMS

FIELD OF THE INVENTION

The present invention relates generally to a method and apparatus for pad printing, and more particularly, to a method and apparatus for pad printing the external surfaces of tubular, cylindrical and like shaped items.

BACKGROUND OF THE INVENTION

Pad printing machines are highly desirable for printing spherical, rounded, cylindrical, and other non-flat surfaces. Pad printing machines typically comprise a flexible ink transfer pad that receives an ink image from a flat inked gravure plate upon being placed into pressure contact with the gravure plate. The transfer pad is then removed from the gravure plate and placed into pressure contact with the curved or cylindrical surface to be printed. The flexible nature of the transfer pad enables the ink image to be transferred from the pad onto the curved printing surface.

Since the flexible transfer pad cannot be deformed completely around a cylindrical surface, heretofore it has been difficult to effect 360 degree printing about tubular or other cylindrical items. It is known to secure the ends of a tubular item to be printed by clamps, pad print a 180 degree surface of the tube, return the ink transfer pad to the gravure plate to receive a further ink image, rotate the clamps and the tube held therein 180 degrees, and then to repeat the printing cycle on the opposite side of the tube. Not only is such procedure time consuming, it is difficult to match the two separate printed images on opposite sides of the cylindrical surface. This is particularly a problem when printing relatively thin lines about the cylindrical surface since even a slight offset between the two separate printed images can be noticeable. Hence, such conventional procedure does not result in quality printing of continuous images which must extend more than 180 degrees, up to 360 degrees, about the cylindrical surface.

OBJECTS AND SUMMARY OF THE INVENTION

It is an object of the present invention to provide an improved pad printing method and apparatus for tubular, cylindrical or like configured items.

It is another object to provide a method and apparatus as characterized above which is adapted to effect 360 degree printing about a cylindrical item in a one step process.

A further object is to provide a method and apparatus of the foregoing type which effects uninterrupted 360 degree printing about a cylindrical item. A related item object is to provide a method and apparatus in which ink is continuously applied about the cylindrical surface so as to effect improved printing quality without breaks or unevenness in the printed image.

Still another object is to provide a pad printing machine of the above kind which is relatively simple in construction and operation and which lends itself to economical manufacture and use.

Other objects and advantages of the invention will become apparent upon reading the following detailed description and upon reference to the drawings, in which:

Figure 1:
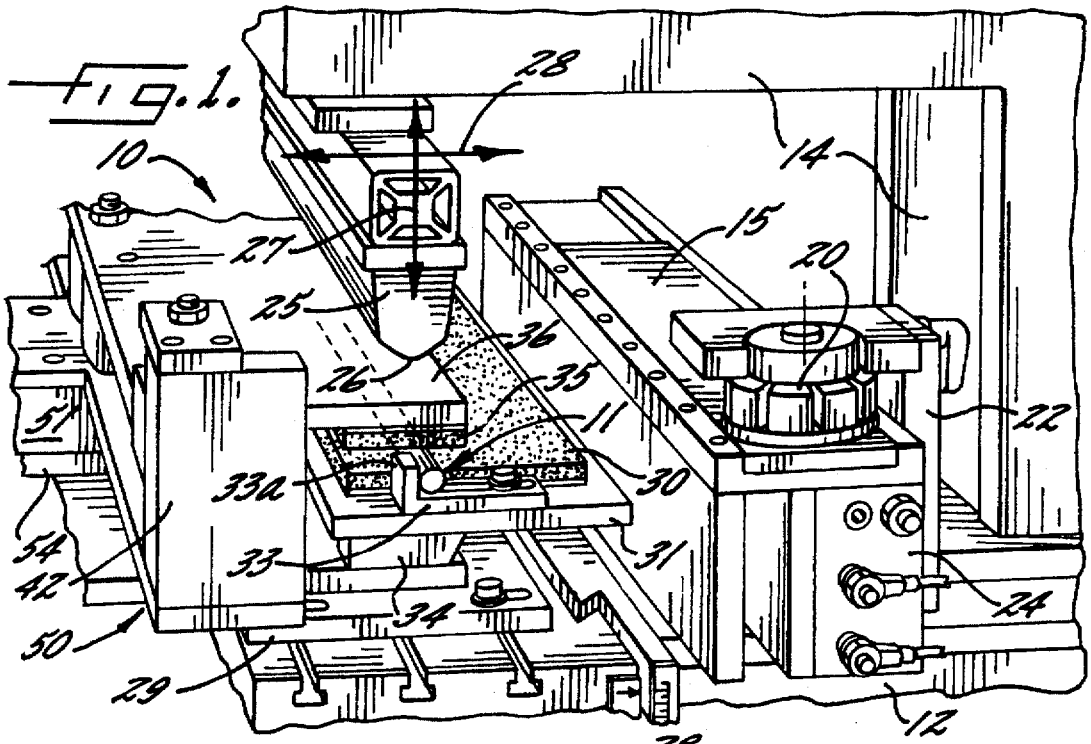
FIG. 1 is a fragmentary perspective of a pad printing machine according to the present invention.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE PREFERRED EMBODIMENT

Referring now more particularly to the drawings, there is shown an illustrative pad printing machine 10 embodying the present invention adapted for printing cylindrical, tubular, or like configured items 11. The pad print machine 10 includes a frame which has a base 12 and an upstanding frame portion 14. A flat gravure plate 15, also commonly known as a cliche, is mounted on the base 12. The gravure plate 15 may be of any suitable material, typically metal, plastic or a combination thereof, and normally is photoengraved on an upper surface with a pattern which is to be printed by operation of the machine.

For supplying printing ink to the gravure plate 15, an ink cup 20 is provided. The ink cup 20 can be of a conventional open bottom type for free access of ink to an upper surface of the gravure plate 15 with an appropriate doctor blade or knife ring around the lower open end thereof. For moving the ink cup 20 in reciprocating fashion along the length of the gravure plate 15, the ink cup 20 is supported in depending relation from an L-shaped support arm 22 that is connected to a piston of an air cylinder 24 disposed beneath the gravure plate 15. Actuation of the air cylinder 24 will move the arm 22 and the ink cup 20 suspended therefrom along the length of the gravure plate 15 to supply ink to the plate following each printing operation, as is known in the art. Appropriate limit switches may be provided near the ends of the gravure plate 15 for limiting the length of travel of the ink cup 15 and actuating return movement. It will be understood by one skilled in the art that other means for supply printing ink to the gravure plate may be provided, such as a conventional open ink well.

A transfer pad 25 is mounted on the upstanding frame portion 14 for vertical and horizontal reciprocating movement relative to the gravure plate 15. The transfer pad 25 preferably is formed of flexible silicon and has an elongated hollow construction, with a V-shaped, lowermost end 26. Appropriate air cylinders or other suitable mechanical or electrical operating means may be provided for effecting vertical and horizontal movement of the transfer pad 25, as indicated by the arrows 27, 28, respectively, in FIG. 1, as is known in the art. When the ink cup 20 has reached the end of its ink application stroke, the ink transfer pad 25 may be moved vertically downwardly into pressure contact with the gravure plate 15. The transfer pad 25 is then raised vertically upwardly, having picked up the ink image for the gravure plate, and then moved to a forward ready position.

Figure 2:
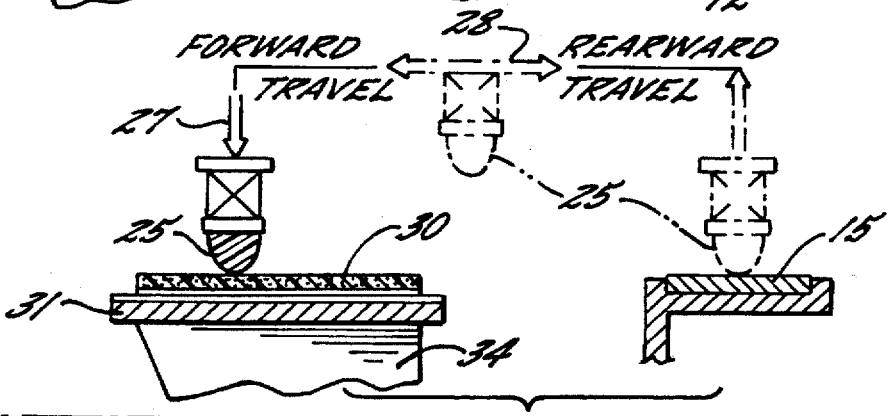
FIG. 2 is a diagrammatic depiction of movement of the flexible ink transfer pad during a printing operation.

In accordance with the invention, the printing machine includes a flat ink transfer plate for receiving the ink image from the pad and means for rolling the cylindrical item to be printed over the ink transfer plate for effecting continuous uninterrupted printing about the outer surface thereof in a one step operation. To this end, in the illustrated embodiment, the pad printing machine 10 has a flat ink transfer plate which comprises a first or lower flat silicon plate 30 mounted on an upper side of a mounting plate 31. The silicon ink transfer plate 30 in this instance is adhesively affixed to an intermediate aluminum plate 32, which in turn is bolted to the mounting plate 31. The mounting plate 31 is supported by a pair of uprights 34 that in turn are mounted in fixed relation to the machine base 12 through a frame plate 29. The cylindrical item 11 to be printed is positionable onto the silicon ink transfer plate 30 at a forward location and the transfer pad 25 is operable, upon actuation of its operating means, for vertical downward movement into pressure contact with the upper surface of the silicon ink transfer plate 30, thereby transferring the ink image from the transfer pad 25 to the silicon ink transfer plate 30 (FIG. 2). The transfer pad 25 is then raised vertically upwardly to its ready position and then horizontally rearwardly to a home position over the gravure plate 15.

Figure 3A:
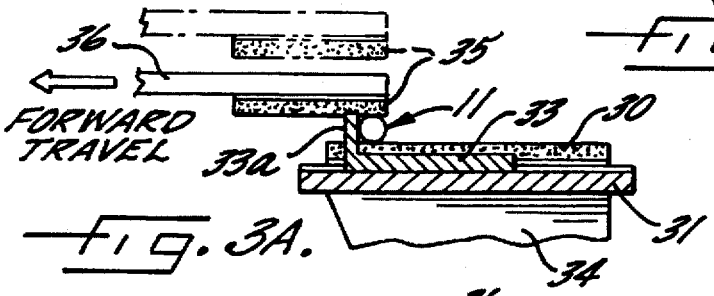
FIGS. 3A and 3B depict operation of means for continuously transferring an ink image onto a cylindrical item during a printing operation.

To facilitate placement of a cylindrical item 11 to be printed in predetermined starting position on the ink transfer plate 30 prior to printing, a pair of adjustable stops 33 are mounted on the mounting plate 31 on opposite lateral sides of the ink transfer plate 30. The adjustable stops 33 this case are L-shaped, having an upstanding locating portion **33*a* and an elongated horizontal portion 33*b* formed with a slot 33*c* that permits adjustable positioning of the stop 33 along the mounting plate 31 and securement thereto by tightening screws 37. The cylindrical item 11 to be printed can be placed in a predetermined starting position on the ink transfer plate 30 by positioning the cylindrical item against rear sides of the locator portions 33*a*** of the stops, as depicted in FIGS. 1 and 3A.

In carrying out the invention, the means for rolling the cylindrical item 11 to be printed over the transfer plate 30 includes a second or upper flat pressure plate 35 affixed to the underside of a mounting plate 36. The pressure plate 35 preferably is made of the same silicon material as the lower silicon ink transfer plate 30 and is movable into engaging relation with a cylindrical item 11 positioned on the ink transfer plate 30.

For establishing the desired spacing between the silicon plates 30, 35, the upper silicon plate 35 is mounted for selected vertical positioning relative to the lower silicon plate 30. For that purpose, the mounting plate 36 is secured to an upper end of a piston rod 38 of an air cylinder 39 supported in upstanding relation to a base plate 40. The cylinder 39 is operable for selectively raising and lowering the mounting plate 36 and the silicon pressure plate 35 secured thereto.

For guiding vertical movement of the mounting plate 36 and silicon pressure plate 35, guides 41 are mounted at opposite ends of the mounting plate 36 for sliding engagement with upstanding vertical guide rails 42. The guides 41 in this case are secured to respective vertical side plates 43, which in turn are bolted to opposite ends of the mounting plate 36. The guides 41 are formed with outwardly opening channels **41*a* which ride on complementary shaped rails 44 affixed in upstanding relation to the base plate 40**.

Figure 4:
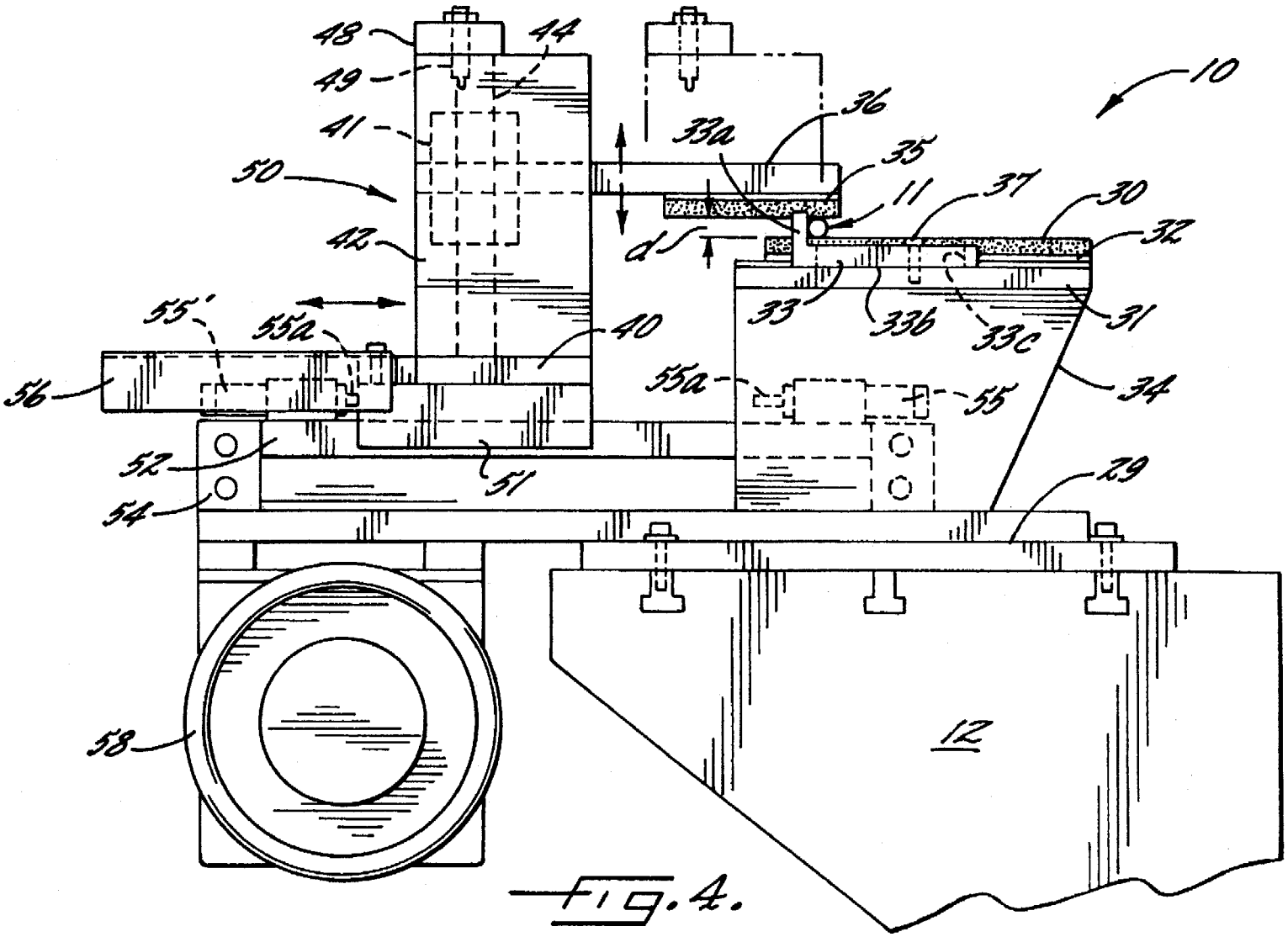
FIG. 4 is a side elevational view, in partial section, of the illustrated pad printing machine.
Figure 5:
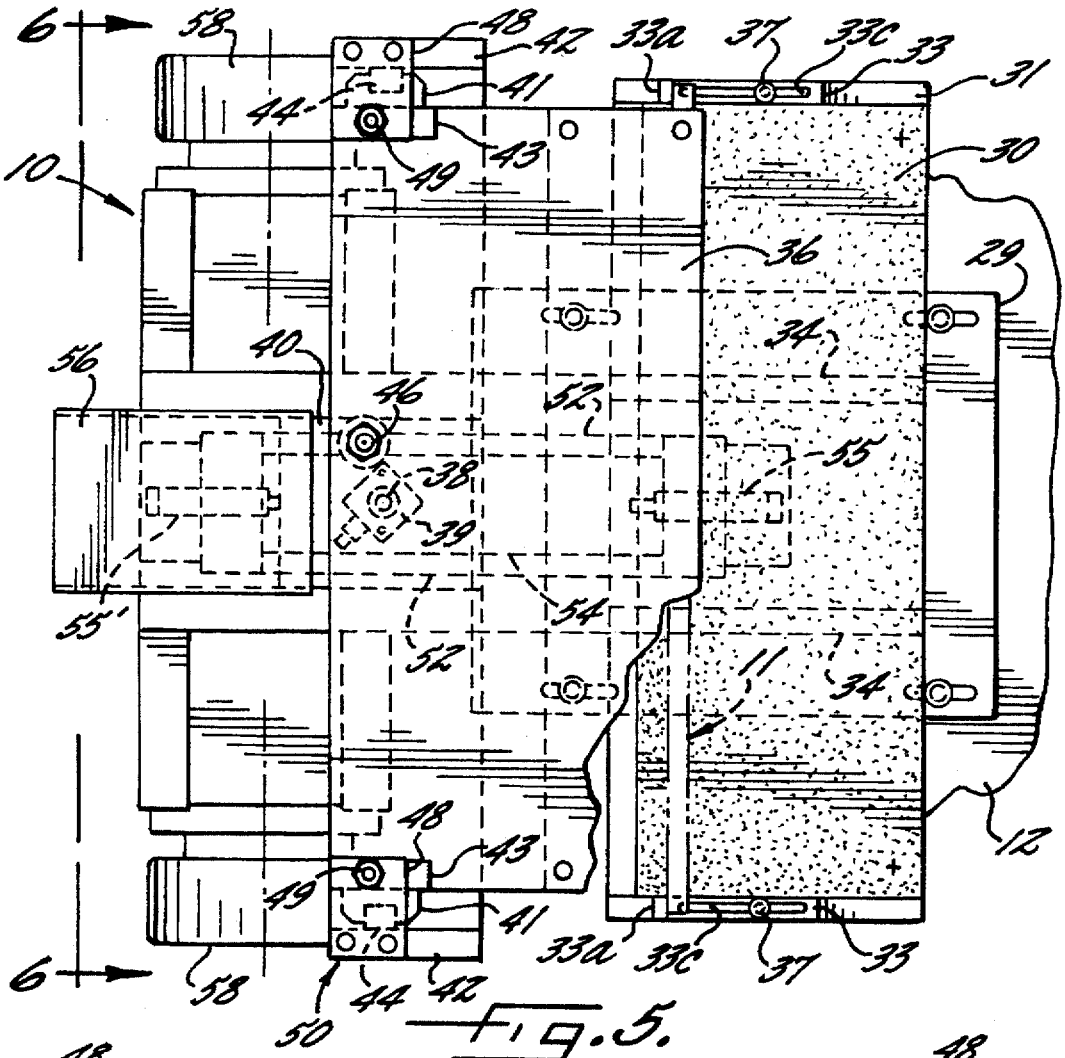
FIG. 5 is a top plan view of the illustrated pad printing machine, with portions broken away.
Figure 6:
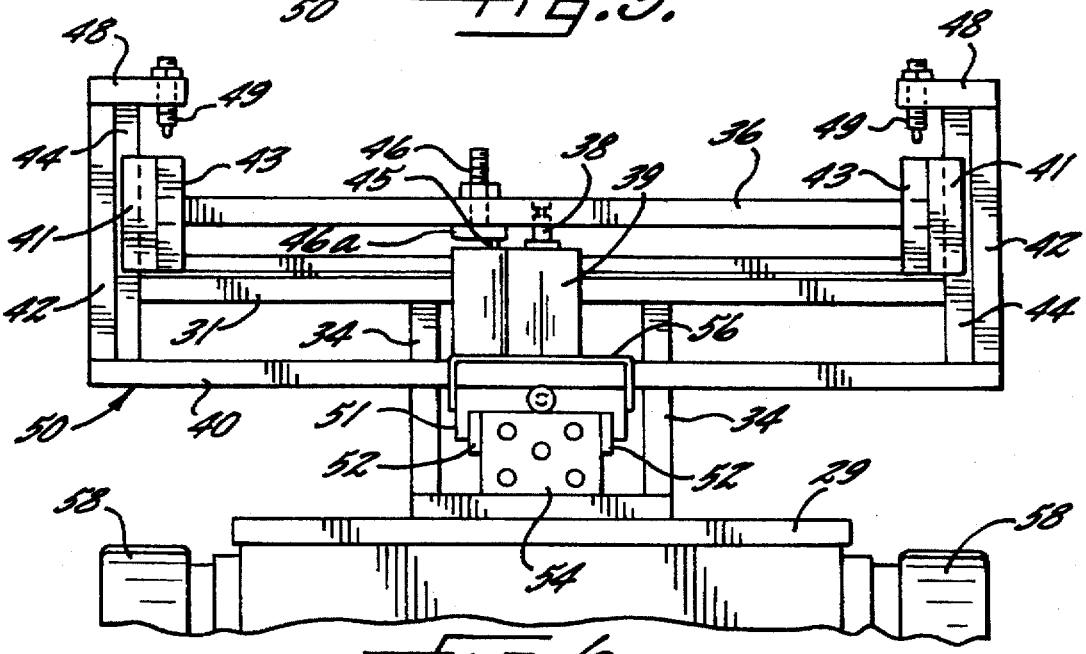
FIG. 6 is a side elevational view of the illustrated pad printing machine, taken in the plane of line 6—6 in FIG. 5.

For selectively limiting downward movement the silicon pressure plate 35 for the desired spacing with respect to the silicon ink transfer plate 30, and hence, the desired contact pressure with the cylindrical item 11, an upstanding stop 45 is mounted adjacent the air cylinder 39 and an adjustable stop 46 is provided in threaded engagement with the mounting plate 36. The adjustable stop 46 has a head **46*a* depending from an underside of the mounting plate 36. It will be seen, with reference to FIG. 6, that by adjustable positioning of the head 46*a* of the stop 46 relative to the mounting plate 36, a limit for downward movement of the mounting plate 36 and pressure plate 35 can be selectively established. Preferably, the downward position of the mounting plate 36 is set such that the distance "d" between the opposed surfaces of the silicon pressure plate 35 and the silicon ink transfer plate 30 is slightly less than the diameter of the cylindrical item to be printed (FIG. 4). For limiting upward movement of the pressure plate 35, laterally extending stop plates 48 are secured at the upper ends of the guide rails 44, each having a respective threaded adjustable stop 49 depending therefrom for enabling selected adjustment in the upward stroke of the mounting and pressure plates 35, 36**.

In carrying out the invention, the means for rolling the cylindrical item 11 to be printed over the ink image on the silicon ink transfer plate 30 further includes means for effecting relative parallel movement between the opposing surfaces of the ink transfer and pressure plates 30, 35. In the illustrated embodiment, the upper silicon ink pressure plate 35 is horizontally movable over the ink transfer plate 30, and for this purpose, the pressure plate 35 is a part in a slide assembly or carriage 50 which includes the base 40, air cylinder 39, and guide rails 44. For guiding movement of the slide assembly 50, a yoke 51 is affixed to the underside of the base plate 40 for sliding movement on a rearwardly extending guideway 52. To move the yoke 51 and slide assembly 50 affixed thereto in rearward and forward directions, the yoke 51 is coupled to the piston of a rodless cylinder 54 mounted on the frame plate 29 forwardly of the slide assembly 50. In order to cushion and limit movement of the slide assembly 50 in a horizontal direction, shock absorbers 55 are mounted at ends of the guideway 52. The shock absorbers 55 may be of a conventional oil filled type, having rods **55*a* that are rectractably engageable by the slide assembly upon reaching the maximum limit of travel on the guideway. A U-shaped cover plate 56 in this instance is affixed in forwardly extending relation to the yoke 51 for covering the air cylinder 54**.

Actuation of the air cylinder 54 is effective for moving the slide assembly 50 and silicon pressure plate 35 rearwardly relative to the silicon ink transfer plate 30 and for causing a cylindrical item 11 to be rolled over the ink transfer plate 30 in a manner which causes the transfer of the ink image from the ink transfer plate 30 onto the outer periphery of the cylindrical item 11 in a continuous and uninterrupted manner. Depending upon the stroke of the air cylinder 54, and hence, the length of travel of the silicon pressure plate 35, images can be transferred in a continuous one step operation up to 360 degrees about the cylindrical item for quality printing of even fine lines and images, without the necessity for matching separate printed images, heretofore required in multi-step pad printing of cylindrical surfaces.

Figure 3B:
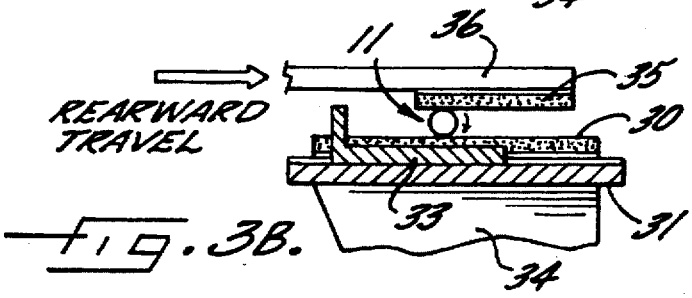

In operation of the printing machine 10, as depicted in FIGS. 2, 3A and 3B, a cylindrical item 11 to be printed is positioned against rear sides of the locator portions **33*a* of the stops 33 so as to extend transversely across the silicon ink transfer plate 30 at a forward location. Upon actuation of a start button for the machine control, the air cylinder 39 will move the pressure plate 35 to its lowered position in engaging relation with the cylindrical item 11. The ink transfer pad 25 will simultaneously initiate its cycle upon actuation of its operating means, being lowered downwardly into pressure contact with the gravure plate 15 for receiving an ink image. Through sequential operation, the ink transfer pad is raised vertically upwardly and then forwardly in a horizontal plane to its ready position, and then downwardly into pressure contact with the silicon ink transfer plate 30, thereby transferring the ink image onto the ink transfer plate 30. The transfer pad 25** is then raised upwardly and then rearwardly for return to its home position.

Following the transfer of the ink image to the silicon ink transfer plate 30, the slide assembly 50 which carries the pressure plate 35 is moved rearwardly through actuation of the air cylinder 54, causing the pressure plate 35 to roll the cylindrical item 11 over the silicon ink transfer plate 30 and to apply the image on the ink transfer plate 30 about the cylindrical item 11 in a continuous and uninterrupted manner, without break or unevenness. Upon completion of the rolling cycle effected by rearward movement of the slide assembly 50 and pressure plate 35, the pressure plate 35 is returned to its raised position by operation of the air cylinder 39 and the slide assembly 50 returned to its initial forward position, enabling removal of the printed item from the ink transfer plate 30. During that sequence, the ink cup 20 has been moved through its operating cycle along the length of the gravure plate 15 for applying ink thereto for the next printing cycle. It will be understood that the foregoing operation can be controlled by an appropriate microprocessor based central control. Large stop bottoms 58 in this case are provided at a forward location for easy access for interrupting the machine operation on an emergency basis.

From the foregoing, it can be seen that the pad printing machine of the present invention is adapted to effect up to 360 degree printing about cylindrical items in a one-step process without breaks or unevenness in the printing image. The pad printing machine, furthermore, is relatively simple in construction and operation, and lends itself to economical manufacture and efficient operation.

What is claimed is:

1. A pad printing machine for printing images on the external surfaces of cylindrical items comprising a gravure plate having an upper ink receiving gravure surface, a flexible ink transfer pad movable into pressure contact with said gravure surface for receiving an ink image therefrom, a flat ink transfer plate, said ink transfer pad being movable into pressure contact with said ink transfer plate for transferring an ink image from said transfer pad to said ink transfer plate, a flat pressure plate mounted in substantially parallel relation to said ink transfer plate, and said ink transfer plate and pressure plate being relatively movable in parallel relation to each other for rolling a cylindrical item to be printed over said ink transfer plate and transferring an ink image from said ink transfer plate to an outer surface of such cylindrical item as it is rolled over the transfer plate.

2. The pad printing machine of claim 1 in which said ink transfer plate and pressure plate are each made of silicon.

3. The pad printing machine of claim 1 in which said transfer pad, ink transfer plate, and pressure plate each are made of silicon.

4. The pad printing machine of claim 1 in which said ink transfer plate and pressure plate are horizontally movable relative to each other for rolling a cylindrical item to be printed over said ink transfer plate.

5. The pad printing machine of claim 4 in which said pressure plate and ink transfer plate are vertically movable relative to each other.

6. The pad printing machine of claim 1 including a machine frame, said transfer plate being mounted in fixed relation to said machine frame, and said pressure plate being mounted for relative horizontal and vertical movement with respect to said pressure plate.

7. The pad printing machine of claim 6 in which said pressure plate is movable between a first raised position and a lowered position spaced a distance from said ink transfer plate which is less than the diameter of the cylindrical item to be printed.

8. The pad printing machine of claim 7 in which said pressure plate is carried by a slide assembly, and said slide is horizontally movable relative to said machine frame.

9. The pad printing machine of claim 8 in which said pressure plate is vertically movable with respect to said slide assembly.

10. The pad printing machine of claim 9 including a first selectively actuatable cylinder carried by said slide assembly for raising and lowering said pressure plate with respect to the slide assembly, and a second selectively actuatable cylinder for horizontally moving said slide assembly relative to said frame.

11. The pad printing machine of claim 9 including a guide supported by said frame, and said slide assembly including a yoke positionable on said guide for relative horizontal movement.

12. The pad printing machine of claim 7 including adjustable stops disposed on opposite sides of said transfer plate for locating a cylindrical item to be printed in a predetermined starting position thereon prior to being rolled over said transfer plate.

13. The pad printing machine of claim 12 in which said adjustable stops are L-shaped members having an elongated adjustable mounting portion and an upstanding locating portion against which a cylindrical item to be printed is positioned prior to printing.

14. The pad printing machine of claim 10 including a selectively adjustable stop for limiting downward movement of said pressure plate to a predetermined space position relative to said ink transfer plate.

15. The pad printing machine of claim 1 including an open ended cup supported in inverted relation on said gravure plate for cyclically applying ink to said gravure plate.

16. The pad printing machine of claim 15 in which said gravure plate has an elongated configuration, and said ink cup is mounted for reciprocating movement along the elongated gravure plate for applying ink thereto.

17. The pad printing machine of claim 15 in which said gravure plate has an elongated configuration, and said transfer pad has an elongated hollow configuration.

18. The pad printing machine of claim 1 in which said ink transfer pad is horizontally movable between a first position above said gravure plate and a second position above said ink transfer plate, and said transfer pad is vertically movable between said first position and said gravure plate and said second position and said transfer plate.

19. The pad printing machine of claim 18 including a first selectively actuatable cylinder for vertically moving said ink transfer pad and second selectively actuatable cylinder for horizontally moving said ink transfer pad.

20. A pad printing machine for printing images on the external surfaces of cylindrical items comprising a gravure plate having an upper ink receiving gravure surface, an ink supply for cyclically applying ink to said gravure surface, a flexible ink transfer pad movable into pressure contact with said gravure surface for receiving an ink image therefrom, a flat ink transfer plate, said ink transfer pad being movable from said gravure plate and into pressure contact with said ink transfer plate for transferring an ink image from said transfer pad to said ink transfer plate, and means for rolling a cylindrical item to be printed over said ink transfer plate for transferring an ink image from said ink transfer plate to an outer surface of such cylindrical item it is rolled over the transfer plate.

21. The pad printing machine of claim 20 in which said cylindrical item rolling means is a flat pressure plate, and said pressure plate and ink transfer plate are relatively movable with respect to each other to effect rolling movement of said cylindrical item over an ink image on said ink transfer plate.

22. The pad printing machine of claim 21 in which said transfer pad, ink transfer plate, and pressure plate each are made of silicon.

23. The pad printing machine of claim 21 in which said pressure plate is carried by a slide assembly mounted for movement relative to said transfer plate.

24. The pad printing machine of claim 23 in which said pressure plate is vertically movable with respect to said slide assembly.

25. The pad printing machine of claim 24 including a mounting plate upon which said pressure plate is secured, and upstanding guide rails for guiding vertical movement of said mounting plate and the pressure plate secured thereto relative to the ink transfer plate.

26. The pad printing machine of claim 24 including a first selectively actuatable cylinder carried by said slide assembly for raising and lowering said pressure plate with respect to the slide assembly, and a second selectively actuatable cylinder for horizontally moving said slide assembly relative to said transfer plate.

27. A method of printing the outer perimeter of a cylindrical item with a flexible ink transfer pad comprising the steps of positioning a cylindrical item to be printed onto a flat ink transfer plate, applying an ink image to said flexible transfer pad by pressing said transfer pad against an inked gravure plate, transferring the ink image from said flexible pad to said transfer plate by removing said transfer pad from said gravure plate and pressing said transfer pad against said ink transfer plate, and rolling said cylindrical item over said ink transfer plate and an ink image applied thereto for transferring the ink image from said ink transfer plate about the outer surface of the cylindrical item as the cylindrical item is rolled.

28. The method of claim 27 including cyclically applying ink to said gravure plate.

29. The method of claim 28 including moving said flexible transfer pad vertically between a lowered position in contact with said gravure plate and a first raised position over said gravure plate, moving said pad between said first raised position to a second raised position over said transfer plate, and moving said flexible pad from said second raised position into contact with said transfer plate.

30. The method of claim 27 including rolling said cylindrical item by pressing the cylindrical item between said ink transfer plate and a pressure plate and effecting relative movement between said pressure plate and transfer plate.

31. The method of claim 30 including moving said pressure plate with respect to said ink transfer plate while said ink transfer plate remains stationary.

32. The method of claim 30 including moving said pressure plate by supporting said pressure plate in a carriage and horizontally moving said carriage relative to said transfer plate.

33. The method of claim 32 including raising and lowering said pressure plate relative to said ink transfer plate by raising and lowering said pressure plate relative to said carriage.

34. The method of claim 30 including moving said pressure plate between a raised position out of contact with said cylindrical item to be printed and a lowered position separated from said transfer plate by a distance less than the diameter of the cylindrical item to be printed with said cylindrical item pressed therebetween, and then effecting relative horizontal movement between said pressure plate and transfer plate.

35. The method of claim 30 including horizontally moving said pressure plate relative to said ink transfer plate for effecting relative movement of said cylindrical item over said ink transfer plate.

* * * * *